US005362106A

United States Patent [19]

Longtin

[11] Patent Number: 5,362,106

[45] Date of Patent: Nov. 8, 1994

[54] SELF-SEALING CARD ASSEMBLY ON CARRIER AND METHODS OF MANUFACTURE

[75] Inventor: Andre G. Longtin, Weare, N.H.

[73] Assignee: Moore Business Forms, Inc., Grand Island, N.Y.

[21] Appl. No.: 37,127

[22] Filed: Mar. 25, 1993

[51] Int. Cl.[5] ..... B42D 15/10

[52] U.S. Cl. ..... 283/109; 283/61; 283/62; 283/904

[58] Field of Search ..... 283/107, 61, 62, 109, 283/904; 428/204, 916; 229/69, 92.8

[56] References Cited

U.S. PATENT DOCUMENTS

| | | | |
|---|---|---|---|
| 3,402,488 | 9/1968 | Leavitt . | |
| 3,647,442 | 3/1972 | Malster . | |
| 3,697,101 | 10/1972 | Loos et al. | 283/62 |
| 3,770,553 | 11/1973 | Hannon . | |
| 4,664,416 | 5/1987 | Steidinger | 283/81 X |
| 4,695,077 | 9/1987 | Pretre | 283/81 |
| 4,732,410 | 3/1988 | Holbein et al. . | |
| 4,890,862 | 1/1990 | Buchholz | 283/62 |
| 4,982,894 | 1/1991 | Schmidt . | |
| 4,986,868 | 1/1991 | Schmidt . | |
| 5,011,190 | 4/1991 | Matsuguchi et al. | 428/204 X |
| 5,058,926 | 10/1991 | Drower | 428/916 X |
| 5,096,229 | 3/1992 | Carlson . | |
| 5,172,938 | 12/1992 | Schmidt | 283/109 |
| 5,173,080 | 12/1992 | Longtin | 283/109 X |
| 5,209,514 | 5/1993 | Herbert | 283/101 X |
| 5,254,381 | 10/1993 | Hoffmann et al. | 283/101 X |

FOREIGN PATENT DOCUMENTS

| | | | |
|---|---|---|---|
| 245396 | 10/1990 | Japan | 283/94 |
| 3132397 | 6/1991 | Japan | 283/94 |
| 2082971 | 3/1982 | United Kingdom | 283/100 |

*Primary Examiner*—Mark Rosenbaum
*Assistant Examiner*—Frances Han
*Attorney, Agent, or Firm*—Nixon & Vanderhye

[57] ABSTRACT

The self-sealing card assembly comprises an intermediate plastic substrate having upper and lower clear polyethylene layers and an intermediate polyurethane layer therebetween, permanent pressure-sensitive adhesive applied to the faces of the polyethylene layers, a release liner overlying approximately one-half of the upper adhesive and an ID card overlying the remaining half of the adhesive. The lower adhesive layer adheres the card assembly to a carrier sheet whereby the card assembly and carrier sheet may form a mailer. The recipient completes the information requested on the ID card, peels the upper three layers from the carrier sheet by separating the upper polyethylene layer from the polyurethane layer, removes the upper half of the release liner and folds the clear polyethylene layer onto the upper surface of the ID card to form the laminated card. To manufacture the assembly, the plastic substrate is passed through adhesive applicators and release liners are adhered to its opposite sides. The upper liner is slit lengthwise in the direction of web travel, one half of the liner is removed and the preprinted ID in continuous web form is applied to the exposed adhesive. The lower liner is then removed and the carrier sheet and card assembly are adhered one to the other.

10 Claims, 2 Drawing Sheets

SELF-SEALING CARD ASSEMBLY ON CARRIER AND METHODS OF MANUFACTURE

TECHNICAL FIELD

The present invention relates to a partially laminated self-sealing card assembly wherein the end user completes the lamination and particularly to a partially laminated card assembly on a carrier sheet wherein the end user may remove the partially laminated card from the sheet and complete the lamination. The present invention also relates to methods of manufacturing the self-sealing card assembly on the carrier sheet.

BACKGROUND

Plastic laminated cards are used for a multiplicity of purposes. For example, cards of this type are often provided for purposes of identification and contain printed information, as well as perhaps pictures or other information on one or both sides and which card is sealed between two plastic sheets. Driver's licenses are typical of these standard laminated products. Frequently, it is desirable that an end user provide information on the identification card and have the capability to assemble it in laminated form. For example, an end user may request an identification card from an organization and that organization may forward to the end user the card and other information, whereby the user can complete the information required by the card and laminate the card between plastic sheets also provided the end user by the organization.

Self-sealing identification cards are, of course, not new per se. For example, in U.S. Pat. No. 4,695,077 a transparent plastic substrate is secured by permanent adhesive to a base stock or bond paper and a release liner, the base stock and release liner each covering approximately one-half of a plastic substrate. The base stock has printing on it which can be completed by an end user by removing the release liner from the remaining half and exposing the adhesive, the end user may fold the portion of the transparent plastic substrate previously covered by the release liner and now with exposed adhesive over the face of the base stock to adhesively secure the plastic substrate to the base stock, thereby covering and protecting it. In U.S. Pat. No. 5,173,080, there is disclosed a similar type of laminated identification card in which one or more intermediate or record copies of the identification card are provided in addition to the materials forming the laminated plastic card.

DISCLOSURE OF THE INVENTION

According to the present invention, a self-sealing card assembly, for example, an identification card, is disposed on a carrier sheet which can be in the form of a mailer of virtually any configuration. The self-sealing card assembly is releasably mounted to the mailer assembly for removal and completion of the lamination by an end user. For example, the end user, i.e., the recipient of the mailer, opens the mailer and removes the partially laminated card assembly from the mailer, completes the information on the card and subsequently folds over the remaining portion of the plastic substrate to form the final laminated card.

More particularly, the card assembly, as applied to the carrier or mailer, includes an intermediate plastic film of three layers, i.e., upper and lower layers of clear polyethylene separated by a polyurethane layer. Permanent pressure-sensitive adhesive is applied to the upper and lower faces of the clear polyethylene layers. The adhesive on the upper layer adheres the identification card along approximately one-half of the upper clear polyethylene layer, while a release liner overlies the remaining portion of the upper adhesive. The lower layer of adhesive adheres the card assembly to the carrier sheet which forms part of the mailer. When the recipient receives the carrier sheet and card assembly, the card may be completed by the recipient and removed from the carrier sheet by separating the upper polyethylene layer from the intermediate polyurethane layer. Once separated, the recipient then removes the upper release liner, exposing the upper permanent pressure-sensitive adhesive, whereby the portion of the clear polyethylene layer with the now exposed permanent adhesive may be folded over the exposed and completed face of the card to complete the lamination of the card.

According to another aspect of the present invention, there is provided a novel and improved method of manufacturing the foregoing card assembly and carrier sheet. The plastic film, including the upper and lower layers of polyethylene separated by the polyurethane layer, are provided in continuous web form and passed between a pair of pressure-sensitive permanent adhesive applicators. Upper and lower release liners are applied over the layers of adhesive. The continuous web passes through a slitter which forms a slit in the upper release layer to divide that layer substantially in half into laterally spaced sections relative to the direction of movement of the web. One-half of the upper liner is then removed to expose the underlying adhesive. A web of bond paper stock is passed through a printer, which prints the desired information on one or both sides of the stock. The bond paper stock is then applied to the lateral section having the exposed adhesive and adhered thereto in side-by-side relation to the remaining release liner overlying the permanent adhesive on the other half of the web. The web may then be further die-cut to remove unwanted portions of the paper stock and is then passed through a collator where the lower release liner is removed. A carrier web is introduced, for example, from the underside of the web, and the card assembly is secured to the web, using the lower adhesive layer. The product may then be rolled, fanfolded, or burst to provide the product in various forms as desired.

In a preferred embodiment according to the present invention, there is provided a self-seal card and carrier sheet assembly, comprising a plastic substrate including first and second layers of plastic material separable from one another, with at least the first layer being transparent, the first and second layers having faces on opposite sides of the substrate with first and second adhesive layers thereon, respectively, a first release liner overlying a portion of the first adhesive layer on the first face of the substrate, a card having indicia thereon and overlying another portion of the first adhesive layer such that the first release liner and the card substantially overlie the entirety of the first adhesive layer, the card assembly being affixed to the carrier sheet by the second adhesive layer and the first release liner being removable from the first adhesive layer for enabling the first layer of plastic material, upon separation from the second layer thereof, to be folded over the card whereby the card is encapsulated along opposite faces by the first layer of plastic material.

In a further preferred embodiment according to the present invention, there is provided a method of manufacturing a self-sealable card assembly and a carrier sheet comprising the steps of providing a plastic substrate with first and second adhesive layers on opposite faces thereof, respectively, and a first release liner overlying the first adhesive layer, removing a portion of the first release liner to expose a portion of the first adhesive layer, applying a card to the exposed portion of the first adhesive layer to form the card assembly and adhering the plastic substrate and the card adhered to the first adhesive layer to the carrier sheet.

Accordingly, it is a primary object of the present invention to provide a novel and improved self-sealing laminated card assembly on a carrier sheet and methods of manufacture.

BEST MODE FOR CARRYING OUT THE INVENTION

Figure 1:
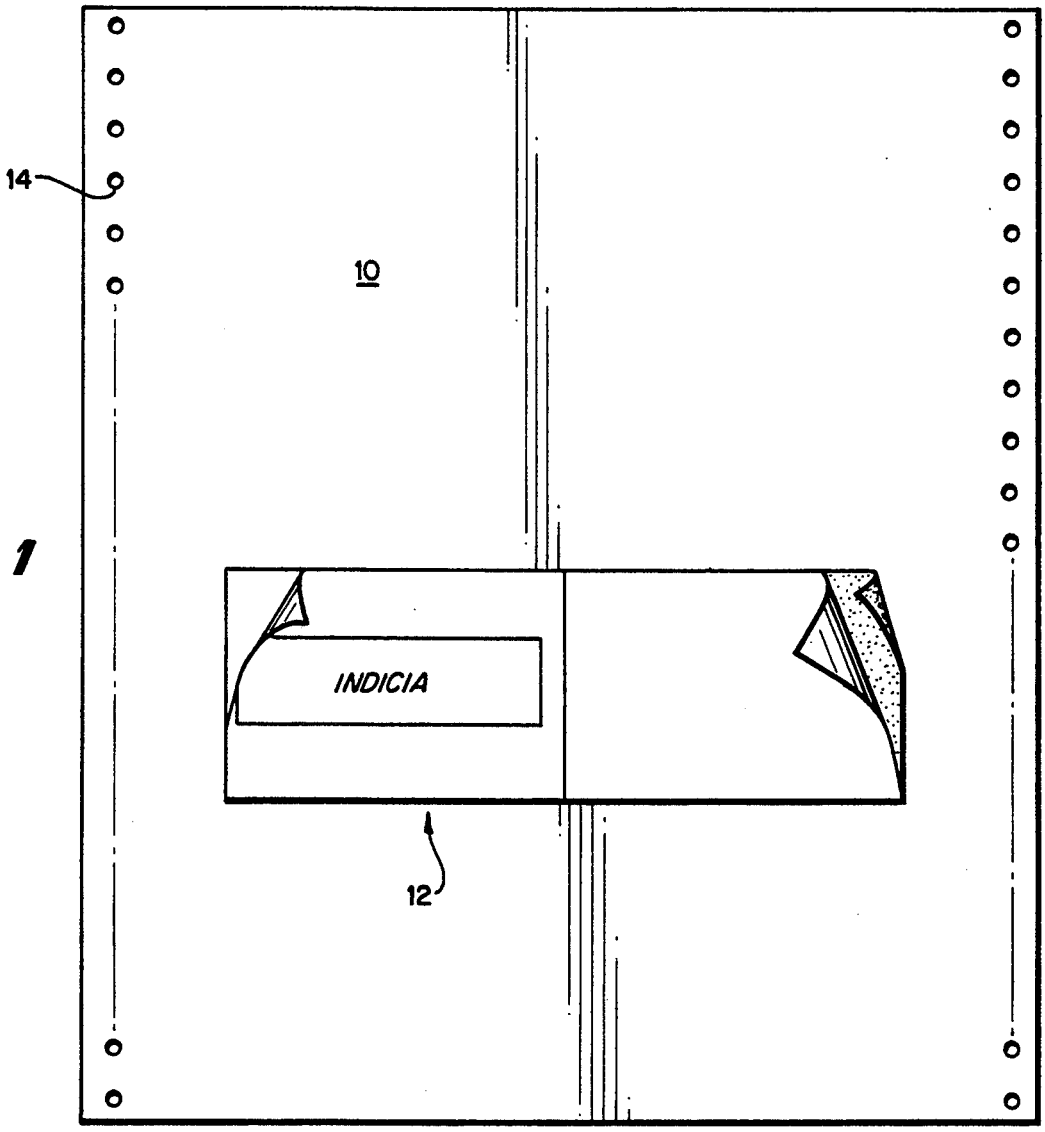
FIG. 1 is a plan view illustrating the card assembly applied to a carrier sheet as the final product of the manufacturing process and illustrating the card assembly as removable from the carrier sheet by the end user.

Referring now to the drawing figures, particularly to FIG. 1, there is illustrated a final card assembly and carrier sheet as manufactured, including a carrier sheet 10 and a self-sealing card assembly, generally designated 12, and adhered to the carrier sheet 10. The carrier sheet 10 may comprise a mailer in which the sheet 10 is folded to form an envelope for the card assembly 12 or to which sheet 10 may be applied an overlying sheet, not shown, in a conventional manner. In FIG. 1, there is illustrated pinholes 14 along opposite sides of the carrier sheet which facilitate the manufacture of the sheet and which may or may not be removed when the carrier sheet and self-sealing card assembly 12 is forwarded to a recipient. It will be appreciated that various perforation lines and/or fold lines may be provided in carrier sheet 10 to provide an effective mailer, with or without one or more additional sheets.

Figure 2:
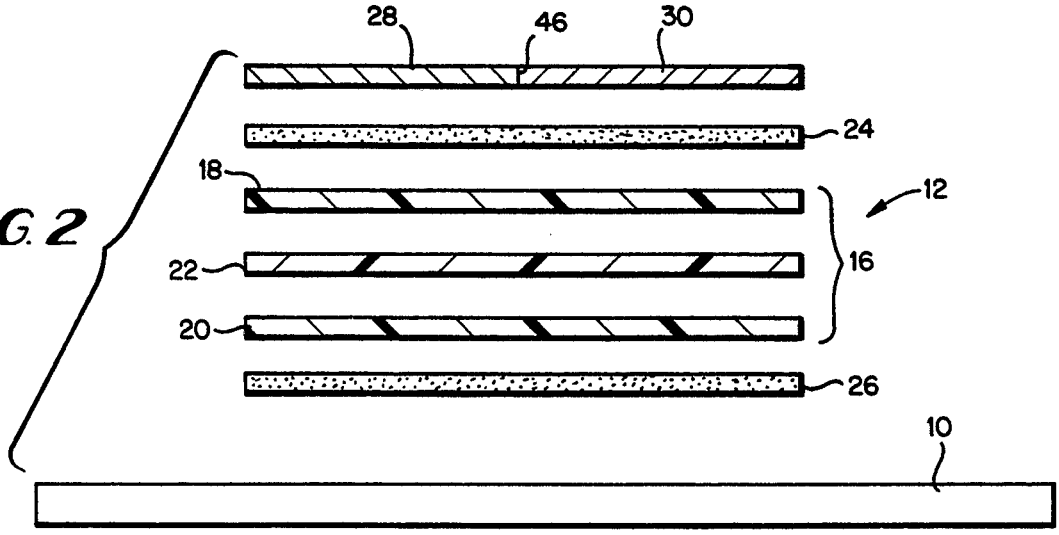
FIG. 2 is an enlarged exploded cross-sectional view illustrating the components of the card assembly and carrier sheet.

Referring now to FIG. 2, the card assembly 12 comprises a composite, including an intermediate plastic substrate 16 having upper and lower plastic sheets, for example, clear polyethylene 18 and 20, respectively, joined to one another by an intermediate polyurethane sheet 22. The plastic substrate 16 is available in the form of a commercial product under the tradename Magic Film, manufactured by Consolidated Graphics, Somerset, N.J. The upper and lower faces of the polyethylene sheets 18 and 20, respectively, are provided with pressure-sensitive permanent adhesive layers 24 and 26, respectively. The lower adhesive layer 26 adheres the card assembly 12 to the carrier sheet 10. The upper adhesive layer 24 adheres a card 28 and a release liner 30 to the card assembly 12. The card 28 and release liner 30 each overlie approximately one-half of the upper adhesive layer 24.

As indicated previously, the combined carrier sheet 10 and self-sealing card assembly 12 are received by an end user who may then complete the information required on the card 28 as set forth in preprinted areas of the card. Once the card is completed, the card assembly 12 is disassembled from the carrier sheet. Particularly, the card assembly is peelable from the carrier sheet by removing the upper three layers. That is, the end user grasps the corners of the card assembly to separate the upper polyethylene layer 18 from the remaining underlying portions of the card assembly. This is easily accomplished, as the polyethylene layer readily separates from the intermediate polyurethane layer, although portions of the polyurethane layer may adhere to the separated upper polyethylene layer 18. Once those three layers 18, 24 and the combined layer of the ID card 28 and release liner 30 are separated, the release liner 30 is peeled from the adhesive layer 24, exposing the upper surface of adhesive 24. The portion of the polyethylene layer having the adhesive 24 exposed thereon is folded over, substantially, about its midpoint, to overlie and adhesively secure to the upper face of ID card 28 and thereby complete the lamination of the card, after assembly by the end user. It will thus be appreciated that the laminated card essentially comprises five layers: approximately one-half of the upper polyethylene layer 18, when folded over, a portion of adhesive layer 24, the ID card 28, the remaining portion of the adhesive layer 24 and the underlying remaining half of the polyethylene layer 18.

Figure 3:
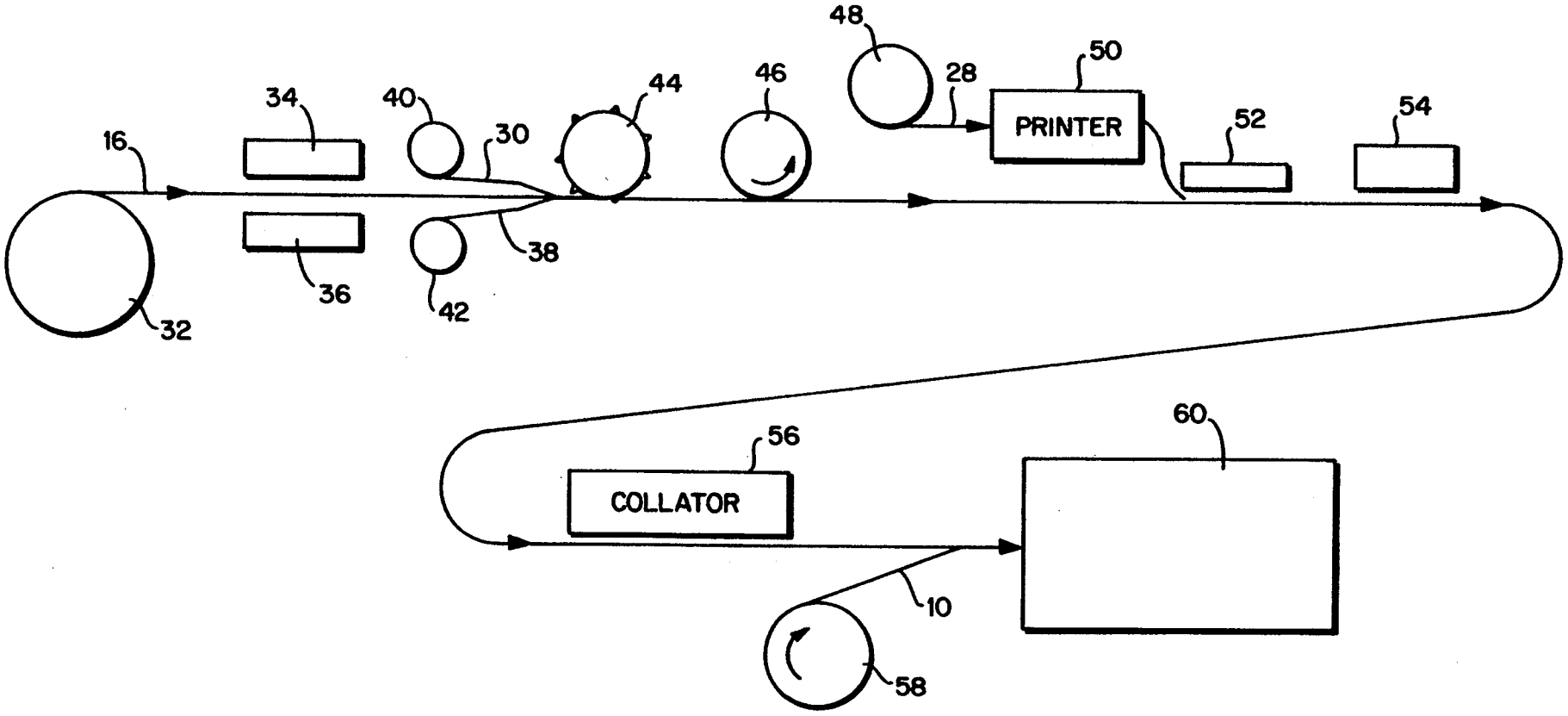
FIG. 3 is a schematic diagram of the manufacturing process for the self-sealing card assembly and carrier sheet hereof.

Referring now to FIG. 3, there is illustrated, in schematic form, a method of manufacturing the self-sealing card assembly and carrier sheet combination. As illustrated, the plastic substrate 16 comprised of the upper and lower clear polyethylene layers 18 and 20 with the intermediate layer of polyurethane 22 is unrolled from roll 32 and passed between upper and lower pressure-sensitive permanent adhesive applicators 34 and 36. Applicators 34 and 36 apply the pressure-sensitive adhesive to the opposite sides of the plastic substrate. Releases liners 30 and 38, provided from rolls 40 and 42, respectively, are then applied on opposite sides of the adhesively coated plastic substrate. The web then passes through a slitter 44 which slits the upper liner 30 in the direction of web travel but does not slit the remaining underlying layers of the web. The slit is illustrated at 46 in FIG. 2. Slit 46 is approximately medially of the width of the web, although it could be otherwise, depending upon the nature of the card assembly desired.

As the web advances, approximately one-half of the upper release liner 30 (the release liner on one lateral side of slit 46) is removed and coiled on a roll 46 for disposal. One-half of the adhesive layer 24 is thus exposed. The ID card 28 is supplied from a roll of bond paper stock 48 and passed through a printer 50, where the cards are continuously printed on one or both sides with the desired information. The preprinted cards in continuous web form are then applied at 52 to the portion of the web having the exposed adhesive 24. The web continues with its upper layer comprised of card 28 along one transverse side and the release liner 30 along its opposite lateral side. The web then passes through a die cutter 54 for removing unwanted portions of the paper stock, if any. The web is then passed through a collator 56 which removes release liner 38 from the underside of the web, exposing adhesive layer 26. The web forming the card assembly is then applied to the carrier sheet 10 supplied from roll 58, the carrier sheet 10 and card assembly being adhesively secured one to the other by the exposed lower adhesive layer 26. Depending upon the customer's requirements, the product is then supplied in a continuous roll, fanfolded or burst into individual sheets, as schematically illustrated at 60.

While the invention has been described with respect to what is presently regarded as the most practical embodiments thereof, it will be understood by those of ordinary skill in the art that various alterations and modifications may be made which nevertheless remain within the scope of the invention as defined by the claims which follow.

What is claimed is:

1. A method of manufacturing a self-sealable card assembly and a carrier sheet comprising the steps of:

providing a plastic substrate with first and second adhesive layers on opposite faces thereof, respectively, and a first release liner overlying a portion of the first adhesive layer;

removing said first release liner to expose said portion of said first adhesive layer;

applying a card to said exposed portion of said first adhesive layer to form the card assembly; and adhering the plastic substrate and the card adhered to the first adhesive layer to the carrier sheet.

2. A method according to claim 1 including providing a second release liner over said second adhesive layer prior to removing the first release liner and removing the second release liner from the second adhesive layer prior to adhering the plastic substrate and the card to the first adhesive layer.

3. A self-seal card and carrier sheet assembly, comprising:

a plastic substrate including first and second layers of plastic materials coupled to and separable from one another, with at least said first layer being transparent, said first and second layers having faces on opposite sides of said substrate with first and second adhesive layers thereon, respectively;

a first release liner overlying a portion of said first adhesive layer on said first face of said substrate;

a card having indicia thereon and overlying another portion of said first adhesive layer such that said first release liner and said card substantially overlie the entirety of said first adhesive layer;

a carrier sheet;

said second layer of plastic material being affixed to said carrier sheet by said second adhesive layer; and said first release liner being removable from said first adhesive layer for enabling the first layer of plastic material, upon separation from said second layer thereof, to be folded over the card whereby the card is encapsulated along opposite faces by said first layer of plastic material.

4. An assembly according to claim 3 wherein said first layer of plastic material is removable from said carrier sheet by separation of said first and second layers of plastic material.

5. An assembly according to claim 1 wherein said plastic substrate occupies a fraction of the area of said carrier paper sheet.

6. An assembly according to claim 1 wherein said plastic substrate includes an intermediate layer of polyurethane between said first and second layers of plastic material to facilitate separation of said first and second layers of plastic material from one another.

7. An assembly according to claim 6 wherein said first and second layers of said substrate are comprised of polyethylene.

8. An assembly according to claim 1 wherein said first adhesive layer comprises a pressure-sensitive permanent adhesive.

9. An assembly according to claim 1 wherein said second adhesive layer comprises a pressure sensitive permanent adhesive.

10. An assembly according to claim 3 wherein said first layer of plastic material is removable from said carrier sheet by separation of said first and second layers of plastic material, said plastic substrate being adhesively secured to said paper sheet and occupying a fraction of the area of said carrier paper sheet, said plastic substrate including an intermediate layer of polyurethane between said first and second layers of plastic material to facilitate separation of said first and second layers of plastic material from one another, said first and second layers of said substrate being comprised of polyethylene, said first and second adhesive layers comprising a pressure-sensitive permanent adhesive.

* * * * *